US008400251B2

(12) United States Patent
Banno et al.

(10) Patent No.: US 8,400,251 B2
(45) Date of Patent: Mar. 19, 2013

(54) ELECTRONIC COMPONENT AND METHOD FOR MANUFACTURING THE SAME

(75) Inventors: Yoshiko Banno, Shiga-ken (JP); Yoichi Nakatsuji, Nagano-ken (JP)

(73) Assignee: Murata Manufacturing Co., Ltd. (JP)

( * ) Notice: Subject to any disclaimer, the term of this patent is extended or adjusted under 35 U.S.C. 154(b) by 165 days.

(21) Appl. No.: 12/821,612

(22) Filed: Jun. 23, 2010

(65) Prior Publication Data

US 2011/0006868 A1 Jan. 13, 2011

(30) Foreign Application Priority Data

Jul. 8, 2009 (JP) ..... 2009-161934

(51) Int. Cl.
*H01F 27/28* (2006.01)
*H01F 5/00* (2006.01)

(52) U.S. Cl. ..... 336/232; 336/200; 336/223

(58) Field of Classification Search ..... 336/200, 336/223, 232
See application file for complete search history.

(56) References Cited

U.S. PATENT DOCUMENTS 6,459,351 B1 * 10/2002 Maki et al. ..... 336/200
6,498,553 B1 * 12/2002 Tanaka et al. ..... 336/83

FOREIGN PATENT DOCUMENTS

| | | | |
|---|---|---|---|
| CN | 101090026 | A | 12/2007 |
| JP | S59-32115 | A | 2/1984 |
| JP | 2006-318946 | A | 11/2006 |
| JP | 2007-324554 | A | 12/2007 |
| JP | 2007-324555 | A | 12/2007 |
| JP | 2008-021788 | A | 1/2008 |
| WO | 2008/004633 | A1 | 1/2008 |

OTHER PUBLICATIONS

Japanese Office Action "Notification of Reasons for Rejection" with mailing date of Oct. 18, 2011; Japanese Patent Application No. 2009-161934 with translation.
The first Office Action issued by the State Intellectual Property Office of the P.R.C. on Apr. 25, 2012; Chinese Patent Application No. 201010213528.9.

* cited by examiner

*Primary Examiner* — Mohamad Musleh
*Assistant Examiner* — Ronald Hinson
(74) *Attorney, Agent, or Firm* — Studebaker & Brackett PC; Tim L. Brackett, Jr.; John F. Guay

(57) ABSTRACT

An electronic component includes a multilayer composite including first insulating layers, second insulating layers, and a helical coil. The helical coil is disposed within the multilayer composite and includes a plurality of coil conductors connected to each other with a plurality of via hole conductors. The coil is located corresponding to the region defined by the second insulating layers when viewed in a stacking direction of the first and second insulating layers. The second insulating layers are located in the region coinciding with the locus of the coil without covering the via hole conductors when viewed in the stacking direction.

10 Claims, 7 Drawing Sheets

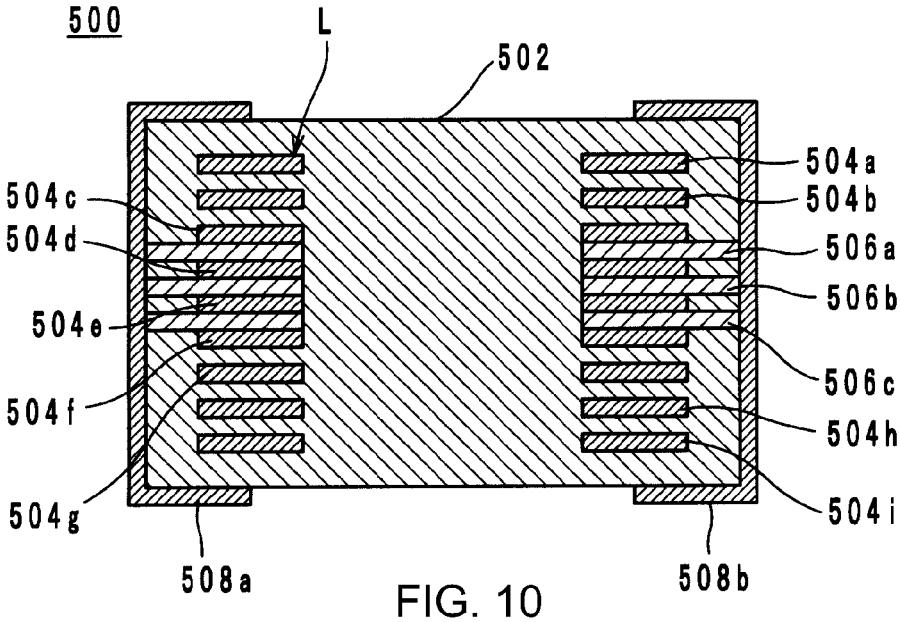
FIG. 10
Prior Art
FIG. 11A
Prior Art
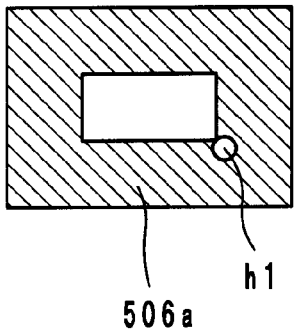
FIG. 11B
Prior Art
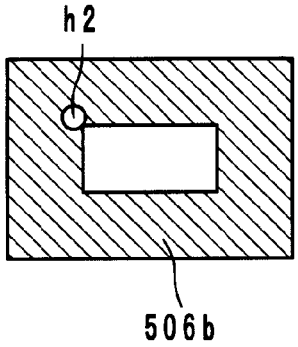
FIG. 11C
Prior Art
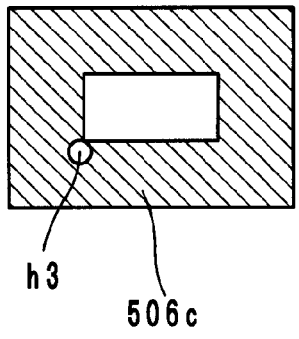

ELECTRONIC COMPONENT AND METHOD FOR MANUFACTURING THE SAME

CROSS REFERENCE TO RELATED APPLICATIONS

The present application claims priority to Japanese Patent Application No. 2009-161934 filed Jul. 8, 2009, the entire contents of which are hereby incorporated herein by reference in their entirety.

BACKGROUND

1. Field of the Invention

The present invention relates to an electronic component and a method for manufacturing the same, and more specifically to an electronic component including a multilayer composite containing a coil and a method for manufacturing the same.

2. Description of the Related Art

FIG. 10 shows a known electronic component 500. FIG. 10 is a sectional view of the known electronic component 500. The electronic component 500 includes a multilayer composite 502, a coil L, and external electrodes 508*a* and 508*b*. The multilayer composite 502 includes a stack of rectangular magnetic layers. The coil L includes coil conductors 504*a* to 504*i* connected to each other with via hole conductors, and is disposed within the multilayer composite 502. The external electrodes 508*a* and 508*b* are disposed on side surfaces of the multilayer composite 502, and are connected to the ends of the coil L.

Furthermore, non-magnetic layers 506*a* to 506*c* are disposed in the multilayer composite 502 so as to improve the DC-superimposing characteristic of the electronic component 500. FIGS. 11A to 11C are plan views of the non-magnetic layers 506*a* to 506*c*, respectively. The non-magnetic layer 506*a* shown in FIG. 11A is disposed between the coil conductors 504*c* and 504*d* and further extends to the outside of the coil L. The non-magnetic layer 506*b* shown in FIG. 11B is disposed between the coil conductors 504*d* and 504*e* and further extends to the outside of the coil L. The non-magnetic layer 506*c* shown in FIG. 11C is disposed between the coil conductors 504*e* and 504*f* and further extends to the outside of the coil L. Thus, the non-magnetic layers 506*a*, 506*b* and 506*c* of the electronic component 500 prevent excessive increase of the magnetic flux density in the multilayer composite 502. Consequently, the magnetic saturation in the electronic component 500 can be prevented, and the DC-superimposing characteristic can be improved.

However, the manufacturing process of the known electronic component 500 is undesirably complicated owing to the following reason. The coil conductors 504*a* to 504*i* are connected to each other with via hole conductors. As shown in FIGS. 11A to 11C, the non-magnetic layers 506*a* to 506*c* have respective via holes h1 to h3 in which the via hole conductors are to be formed. However, the via holes h1 to h3 are formed at different positions, as shown in FIGS. 11A to 11C. Accordingly, if the non-magnetic layers 506*a* to 506*c* are printed on the coil conductors 504*d* to 504*f* and the magnetic layers by printing through a mask, three types of masks are used. Consequently, the manufacturing process of the electronic component 500 becomes undesirably complicated.

The known electronic component may be a multilayer inductor as disclosed in Japanese Unexamined Patent Application Publication No. 2006-318946. This patent document discloses as well that non-magnetic layers can be provided in the multilayer composite to improve the DC-superimposing characteristic. However, it does not describe how the manufacturing process of the electronic component 500 is simplified.

SUMMARY

Embodiments consistent with the claimed invention generally relate to an electronic component including a helical coil, and a multilayer composite including magnetic and same shaped non-magnetic insulating layers; and a method for manufacturing such an electronic component.

According to an embodiment, an electronic component includes a multilayer composite and a helical coil disposed within the multilayer composite. The multilayer composite is formed by stacking a plurality of first insulating layers and a plurality of second insulating layers in a stacking direction. The first insulating layers each have a first magnetic permeability. The second insulating layers have the same shape as each other when viewed in the stacking direction and each have a second magnetic permeability lower than the first magnetic permeability. The helical coil includes a plurality of coil conductors connected to each other with a plurality of via hole conductors. The helical coil is located in a region overlapping with the second insulating layers when viewed in the stacking direction. The second insulating layers are provided without covering the via hole conductors in the region where the helical coil is disposed when viewed in the stacking direction.

According to another embodiment, a method for manufacturing an electronic component includes forming a plurality of first insulating layers. Each first insulating layer has a first magnetic permeability and has a via hole therein. A plurality of second insulating layers having a second magnetic permeability lower than the first magnetic permeability are formed in the same shape as each other on some of the first insulating layers without covering the via holes. The via holes are filled with an electroconductive material to form via hole conductors. Coil conductors are formed on the first insulating layers and the second insulating layers. The first insulating layers and the second insulating layers are stacked to form a multilayer composite containing a helical coil including the coil conductors and the via hole conductors. The first insulating layers and the second insulating layers are stacked such that the second insulating layers are located in the region defined by the coil when viewed in the direction in which the first insulating layers and the second insulating layers are stacked.

Other features, elements, characteristics and advantages of the present invention will become more apparent from the following detailed description of preferred embodiments of the present invention with reference to the attached drawings.

BRIEF DESCRIPTION OF THE DRAWINGS

FIG. 10 is a cross-sectional view of a known electronic component; and

FIGS. 11A to 11C are plan views of non-magnetic layers when viewed in the direction in which the non-magnetic layers are stacked.

DETAILED DESCRIPTION

An electronic component and its manufacturing method according to exemplary embodiments will now be described.

Structure of Electronic Component

Figure 1:
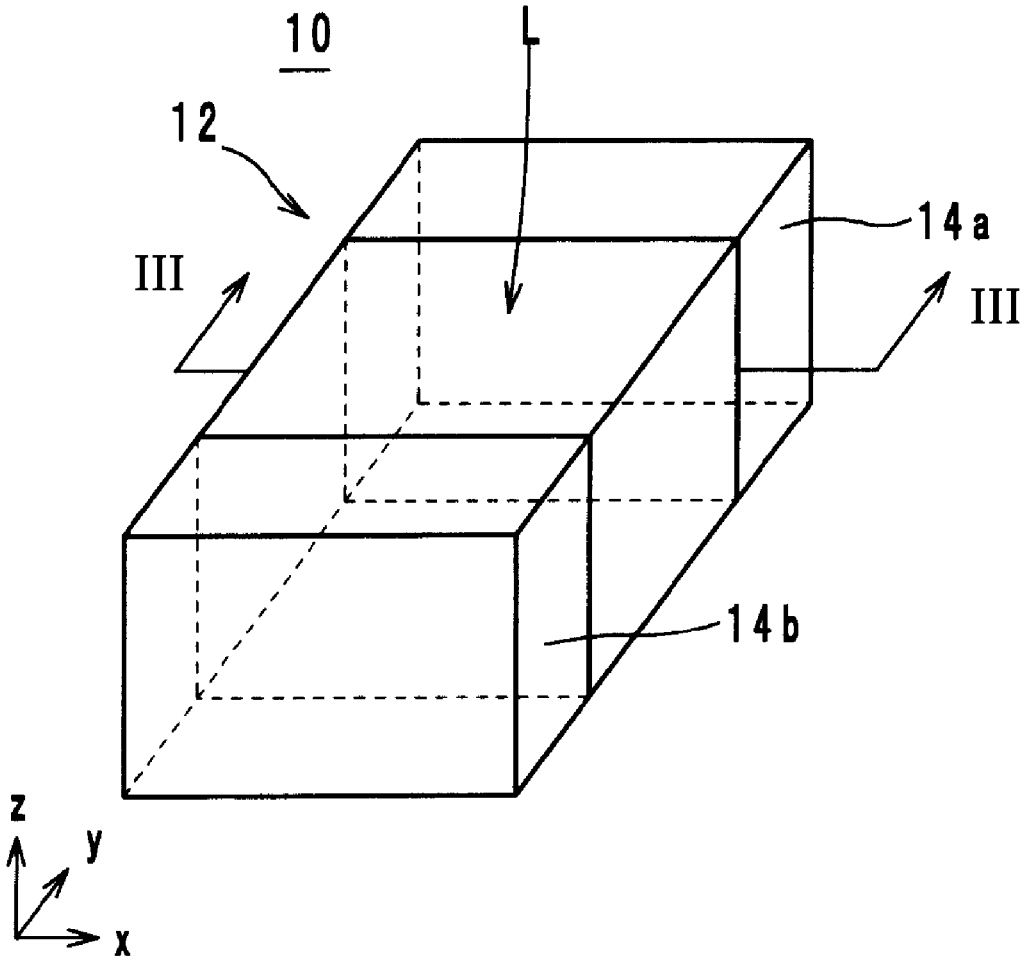
FIG. 1 is an external perspective view of an electronic component according to an exemplary embodiment.
Figure 2:
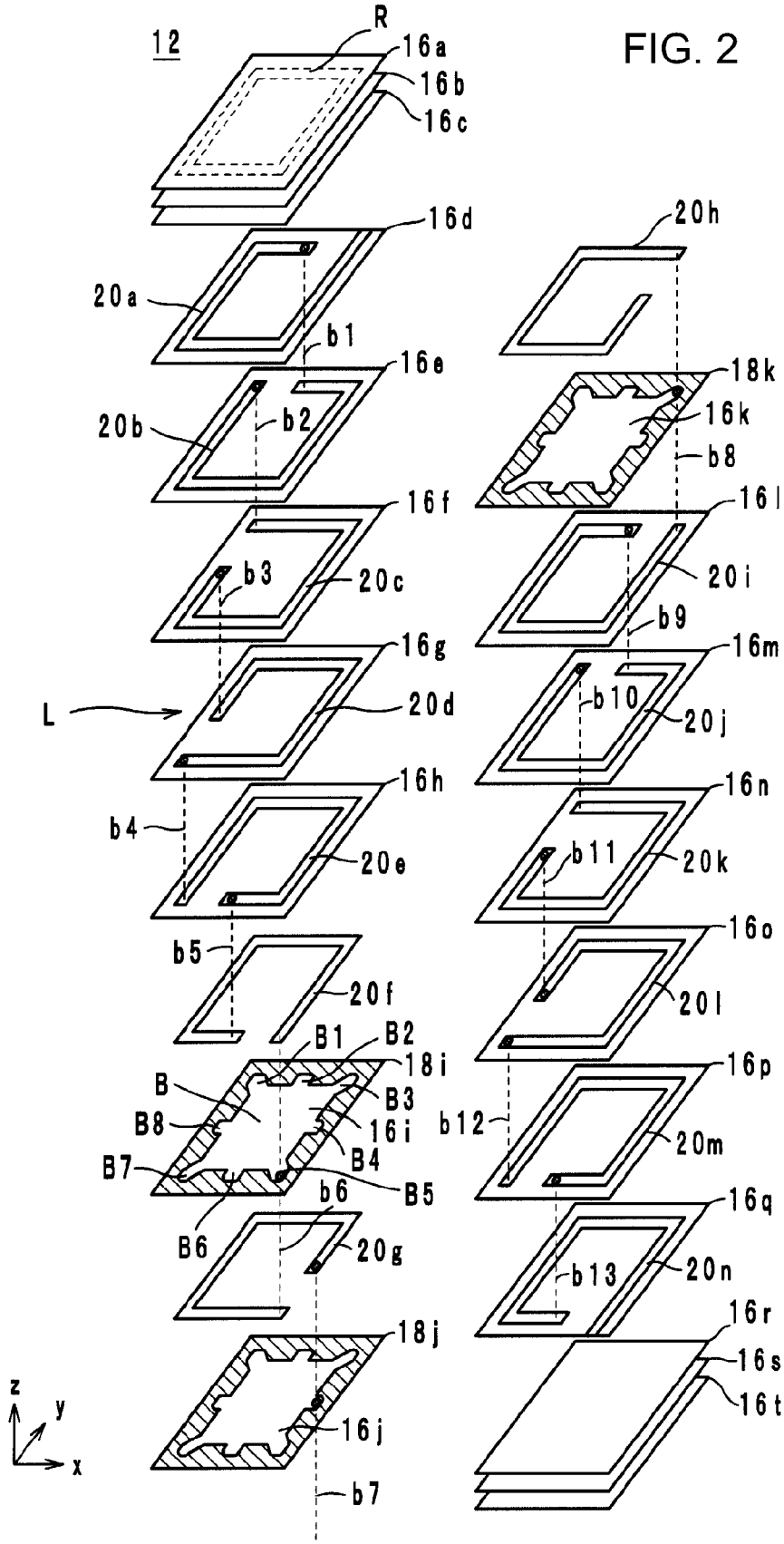
FIG. 2 is an exploded perspective view of a multilayer composite of the electronic component shown in FIG. 1.
Figure 3:
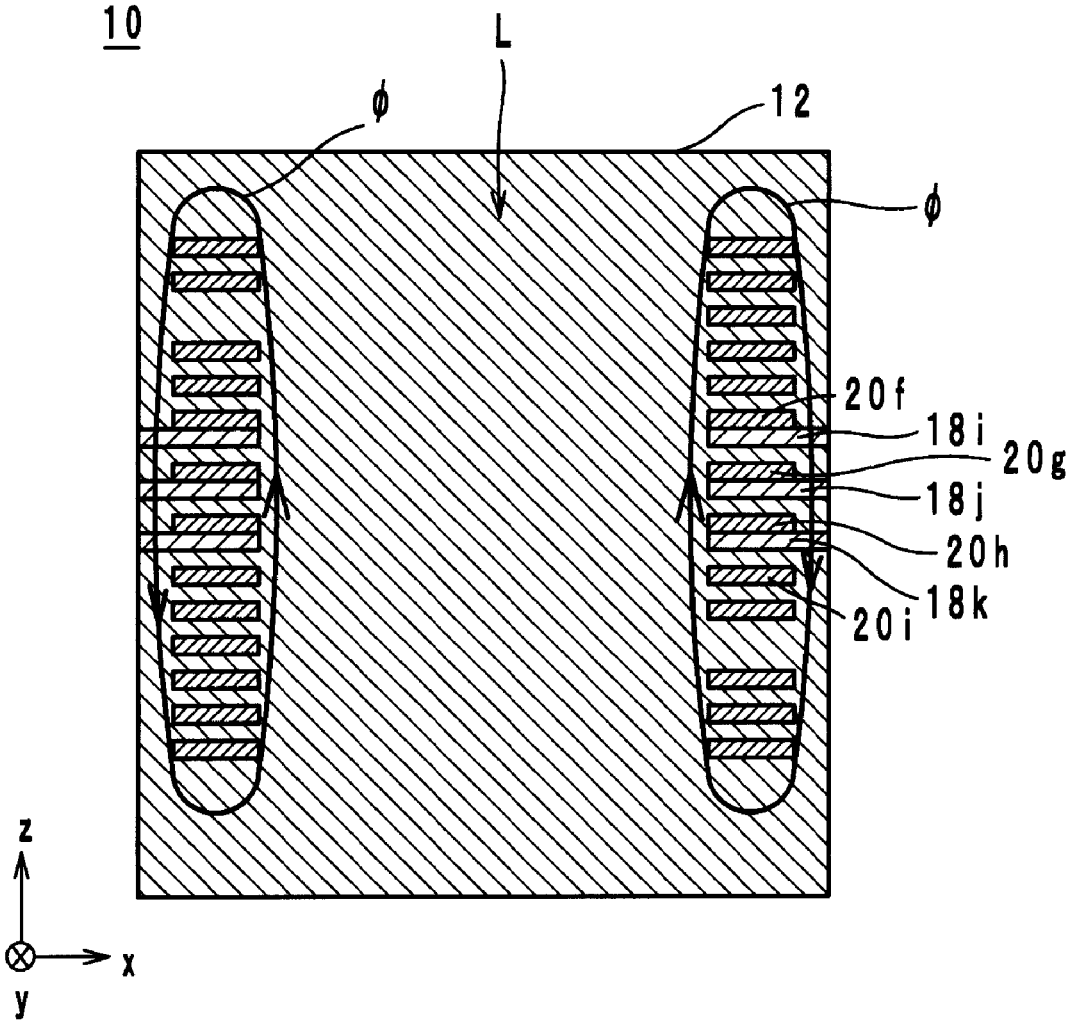
FIG. 3 is a cross-sectional view of the electronic component shown in FIG. 1 taken along line III-III.

FIG. 1 is an external perspective view of an electronic component 10 according to an exemplary embodiment. FIG. 2 is an exploded perspective view of a multilayer composite 12 of the electronic component 10. FIG. 3 is a sectional view of the electronic component 10 shown in FIG. 1 taken along line III-III in FIG. 1. In the following description, the direction in which the layers of the electronic component 10 are stacked is defined as the z-axis direction; the direction along the shorter side of the electronic component 10 is defined as the x-axis direction; and the direction along the longer side of the electronic component 10 is defined as the y-axis direction.

As shown in FIG. 1, the electronic component 10 includes a multilayer composite 12, external electrodes 14 (14*a*, 14*b*) and a coil L. The multilayer composite 12 has a rectangular parallelepiped shape and contains the coil L therein. The external electrodes 14*a* and 14*b* are formed respectively on side surfaces at both ends in the y-axis direction of the multilayer composite 12.

The multilayer composite 12 is formed by stacking first insulating layers 16 (16*a* to 16*t*) and second insulating layers 18 (18*i* to 18*k*), as shown in FIG. 2. The first insulating layers 16 are each a rectangular layer made of a magnetic material having a first magnetic permeability, such as Ni—Cu—Zn ferrite. The second insulating layers 18 each have a magnetic permeability lower than the first magnetic permeability, and are disposed in part of the region defined by the multilayer composite 12 when viewed in the Z-axis direction. In the present embodiment, the second insulating layer 18 is made of a non-magnetic material, such as Cu—Zn ferrite. The second insulating layers 18*i* to 18*k* are disposed on some layers (16*i* to 16*k*) of the first insulating layers 16 to partially cover them. The multilayer composite 12 is thus formed by stacking the first insulating layers 16*a* to 16*t* in the positive z-axis direction in that order with the second insulating layers 18*i* to 18*k* provided, or disposed on the first insulating layers 16*i* to 16*k*. The second insulating layers 18 have a specific shape, and this will be described later.

As shown in FIG. 2, the coil L includes coil conductors (20*a* to 20*n*) and via hole conductors b1 to b13. More specifically, the coil L is formed within the multilayer composite 12 by connecting the coil conductors 20*a* to 20*n* with the via hole conductors b1 to b13, and is a helical coil whose axis extends in the z-axis direction. The coil L traces a closed loop or locus, which in this embodiment is a rectangular locus R when viewed in the z-axis direction, and the locus R lies in the region defined by the second insulating layers 18 when viewed in the z-axis direction.

The coil conductors 20*a* to 20*n* are disposed respectively on the main surfaces of the insulating layers 16*d* to 16*h*, 18*i* to 18*k*, and 16*l* to 16*q* on the positive side of the z-axis direction. Although the coil conductors 20*f* to 20*h* are actually provided, or disposed on the second insulating layers 18*i* to 18*k*, respectively, FIG. 2 shows as if the coil conductors 20*f* to 20*h* are separated from the second insulating layers 18*i* to 18*k* for the sake of showing the structure of the second insulating layers 18*i* to 18*k*. Each coil conductor 20 defines part of the locus R of the coil L and includes a line conductor of seven-eighth turn of the locus R, although in some embodiments the turn of the coil conductor 20 can be more or less than seven-eighths of a turn. In other words, the coil conductor 20 has a shape from which a portion equivalent to one-eighth turn of the locus R has been cut off. One end of the uppermost coil conductor 20*a* is drawn out of the shorter side of the first insulating layer 16*d* at the positive side of the y-axis direction and connected to the external electrode 14*a*. Similarly, one end of the lowermost coil conductor 20*n* is drawn out of the shorter side of the first insulating layer 16*q* at the negative side of the y-axis direction and connected to the external electrode 14*b*.

The via hole conductors b1 to b13 pass through the respective first insulating layers 16*d* to 16*p* in the z-axis direction, so that each via hole conductor connects adjacent coil conductors 20. More specifically, the via hole conductor b1 passes through the first insulating layer 16*d* in the z-axis direction to connect the coil conductors 20*a* and 20*b*. The via hole conductor b2 passes through the first insulating layer 16*e* in the z-axis direction to connect the coil conductors 20*b* and 20*c*. The via hole conductor b3 passes through the first insulating layer 16*f* in the z-axis direction to connect the coil conductors 20*c* and 20*d*. The via hole conductor b4 passes through the first insulating layer 16*g* in the z-axis direction to connect the coil conductors 20*d* and 20*e*. The via hole conductor b5 passes through the first insulating layer 16*h* in the z-axis direction to connect the coil conductors 20*e* and 20*f*. The via hole conductor b6 passes through the first insulating layer 16*i* in the z-axis direction to connect the coil conductors 20*f* and 20*g*. The via hole conductor b7 passes through the first insulating layer 16*j* in the z-axis direction to connect the coil conductors 20*g* and 20*h*. The via hole conductor b8 passes through the first insulating layer 16*k* in the z-axis direction to connect the coil conductors 20*h* and 20*i*. The via hole conductor b9 passes through the first insulating layer 16*l* in the z-axis direction to connect the coil conductors 20*i* and 20*j*. The via hole conductor b10 passes through the first insulating layer 16*m* in the z-axis direction to connect the coil conductors 20*j* and 20*k*. The via hole conductor b11 passes through the first insulating layer 16*n* in the z-axis direction to connect the coil conductors 20*k* and 20*l*. The via hole conductor b12 passes through the first insulating layer 16*o* in the z-axis direction to connect the coil conductors 20*l* and 20*m*. The via hole conductor b13 passes through the first insulating layer 16*p* in the z-axis direction to connect the coil conductors 20*m* and 20*n*.

The via hole conductors b1 to b13 are distributed at eight different positions of the locus R as shown in FIG. 2 because the coil conductors 20 each have a path of seven-eighth of the locus R. More specifically, the locus R has a rectangular shape with shorter sides extending in the x-axis direction and longer sides extending in the y-axis direction, and the via hole conductors b1 to b13 are each formed at any one of the four corners, the midpoints of the two longer sides, and the midpoints of the two shorter sides of the rectangular locus R.

The second insulating layers 18 will now be described in detail. As shown in FIG. 2, all the second insulating layers 18*i* to 18*k* are provided, or disposed in the region where the coil L is disposed when viewed in the z-axis direction. More specifically, the second insulating layer 18*i* is disposed between the coil conductors 20*f* and 20*g* stacked in the z-axis direction, as shown in FIG. 3. The second insulating layer 18*j* is disposed between the coil conductors 20*g* and 20*h* stacked in the z-axis direction. The second insulating layer 18*k* is disposed between the coil conductors 20*h* and 20*i* stacked in the z-axis direction.

The shape of the insulating layers 18 will now be described. Since the second insulating layers 18*i* to 18*k* have the same shape when viewed in the z-axis direction, the shape of the second insulating layer 18*i* will be described as a representative.

As shown in FIGS. 2 and 3, the second insulating layer 18*i* is disposed in the region coinciding, or overlapping with the locus R and outside the locus R when viewed in the z-axis direction. In addition, the second insulating layer 18*i* does not occupy the region inside the locus R when viewed in the z-axis direction. In other words, the insulating layer 18*i* has a substantially rectangular opening B therein corresponding to the region inside the locus R when viewed in the z-axis direction, as shown in FIG. 2.

Furthermore, the second insulating layer 18*i* does not cover the via hole conductors b1 to b13. More specifically, since the via hole conductors b1 to b13 are each formed at any one of the four corners, the midpoints of the two longer sides and the midpoints of the two shorter sides of the locus R, the second insulating layer 18*i* is not provided entirely across the four corners, the midpoints of the two longer sides or the midpoints of the two shorter sides of the locus R when viewed in the z-axis direction. Hence, the second insulating layer 18*i* has vacancies B1 to B8 at the positions coinciding with the four corners, the midpoints of the two longer sides and the midpoints of the two shorter sides of the locus R when viewed in the z-axis direction, as shown in FIG. 2. The vacancies B1 to B8 can have shapes that protrude in radial directions from the opening B, as shown in FIG. 2.

Method for Manufacturing the Electronic Component

An exemplary method for manufacturing the electronic component 10 will now be described with reference again to FIG. 2.

First, ceramic green sheets are prepared for the first insulating layers 16. More specifically, ferric oxide ($Fe_2O_3$), zinc oxide (ZnO), nickel oxide (NiO) and copper oxide (CuO) are weighed out in predetermined proportions and blended in a ball mill by a wet process. The mixture is dried and pulverized, and the resulting powder is calcined at about 800° C. for 1 hour. The calcined powder is pulverized in a ball mill by a wet process, and then dried and further pulverized to yield a ferrite ceramic powder.

A binder (vinyl acetate, water-soluble acrylic resin, etc.), a plasticizer, a wetting agent and a dispersant are added to the ferrite ceramic powder, and these materials are blended in a ball mill, followed by degassing under reduced pressure. The resulting ceramic slurry is formed into sheets on a carrier sheet by a doctor blade method. The sheets are dried to yield ceramic green sheets that will act as the first insulating layers 16.

Then, via hole conductors b1 to b13 are formed in the respective ceramic green sheets of the first insulating layers 16*d* to 16*p*. More specifically, via holes are formed in the respective ceramic green sheets of the first insulating layers 16*d* to 16*p* by irradiation with a laser beam. The via holes are filled with an electroconductive paste, such as of that of Ag, Pd, Cu, Au, or their alloys, to form the via hole conductors b1 to b13 by, for example, printing. The ceramic green sheets having via hole conductors b1 to b13 are thus formed for the first insulating layers 16*d* to 16*p* having a first magnetic permeability.

Subsequently, a plurality of second insulating layers 18*i* to 18*k* having a second magnetic permeability lower than the first magnetic permeability are formed on the ceramic green sheets intended for the first insulating layers 16*i* to 16*k* in such a manner that the second insulating layers 18*i* to 18*k* do not cover the via hole conductors b1 to b13. More specifically, ferric oxide ($Fe_2O_3$), zinc oxide (ZnO) and copper oxide (CuO) are weighed out in predetermined proportions and blended in a ball mill by a wet process. The mixture is dried and pulverized, and the resulting powder is calcined at about 800° C. for 1 hour. The calcined powder is pulverized in a ball mill by a wet process, and then dried and further pulverized to yield a ferrite ceramic powder.

A binder (vinyl acetate, water-soluble acrylic resin, etc.), a plasticizer, a wetting agent and a dispersant are added to the ferrite ceramic powder, and these materials are blended in a ball mill, followed by degassing under reduced pressure. The resulting ceramic slurry is applied onto the first insulating layers 16*i* to 16*k* through a mask and then dried to yield the green ceramic layers that will act as the second insulating layers 18*i* to 18*k*.

Subsequently, an electroconductive paste is applied onto the ceramic green sheets intended for the first insulating layers 16*d* to 16*h*, the green ceramic layers intended for the second insulating layers 18*i* to 18*k*, and the ceramic green sheets intended for the first insulating layers 16*l* to 16*q* to form the coil conductors 20*a* to 20*n* by screen printing, photolithography or the like. The electroconductive paste contains, for example, Ag, varnish and a solvent. The step of forming the coil conductors 20*a* to 20*n* may be performed simultaneously with the step of filling the via holes with the electroconductive paste.

The ceramic green sheets for the first insulating layers 16 and the green ceramic layers for the second insulating layers 18 are stacked on one another, thus forming a green mother composite containing a coil L including the coil conductors 20*a* to 20*n* and the via hole conductors b1 to b13. In this instance, the ceramic green sheets for the first insulating layers 16 and the green ceramic layers for the second insulating layers 18 are stacked in such a manner that the green ceramic layers for the second insulating layers 18 are provided, or disposed in the region where the coil L is disposed when viewed in the z-axis direction. More specifically, the ceramic green sheets for the first insulating layers 16*a* to 16*h*, the ceramic green sheets for the first insulating layers 16*i* to 16*k* having the green ceramic layers for the second insulating layers 18*i* to 18*k*, and the ceramic green sheets for the first insulating layers 16*l* to 16*t* are stacked one after another, and the stack is compressed for temporary bonding. The compression was performed at a pressure of about 100 to 120 t for about 3 to 30 seconds. Then, the green mother composite is fully compressed by isostatic pressing.

The mother composite is cut into multilayer composites 12 having predetermined dimensions (for example, 2.5 mm by 2.0 mm by 1.2 mm). Thus, an unfired multilayer composite 12 is prepared. After removal of the binder, the unfired multilayer composite 12 is fired. The removal of the binder is performed, for example, at about 500° C. for about 2 hours in a low-oxygen atmosphere. The firing is performed, for example, at a temperature of about 870 to 900° C. for about 2.5 hours.

A fired multilayer composite 12 is thus completed. The multilayer composite 12 is chamfered by mass finishing. Subsequently, an electrode paste of an electroconductive material mainly containing Ag is applied onto surfaces of the multilayer composite 12. The coatings of the electrode paste are fired at about 800° C. for about 1 hour. Silver electrodes that will act as the external electrodes 14 are thus formed.

Finally, a Ni coating and a Sn coating are formed on the silver electrodes by plating, and, thus, the external electrodes 14 are formed. The electronic component 10 as shown in FIG. 1 is thus completed through the above-described process.

The electronic component 10 can be manufactured by a simplified method, and its manufacturing method can provide a simplified process. In the known electronic component 500, the via holes h1 to h3 are formed in different positions as shown in FIG. 11. Accordingly, if three non-magnetic layers 506*a* to 506*c* are printed on the coil conductors 504*d* to 504*f* and the magnetic layers by printing through a mask, three types of masks are used. Consequently, the manufacturing process of the electronic component 500 becomes undesirably complicated.

On the other hand, in the electronic component 10 according to the present embodiment of the invention, the second insulating layers 18*i* to 18*k* all have the same shape not covering the via hole conductors b1 to b13. Hence, it is not required that the via holes be formed in different positions of the second insulating layers 18*i* to 18*k* even if the via hole conductors b6 to b8 are formed in different positions, as shown in FIG. 2. Consequently, the green ceramic layers intended for the second insulating layers 18*i* to 18*k* can be formed on the ceramic green sheets intended for the first insulating layers 16*i* to 16*k* through only one type of mask. Accordingly, the manufacturing process of the electronic component 10 can be simplified.

Figure 4:
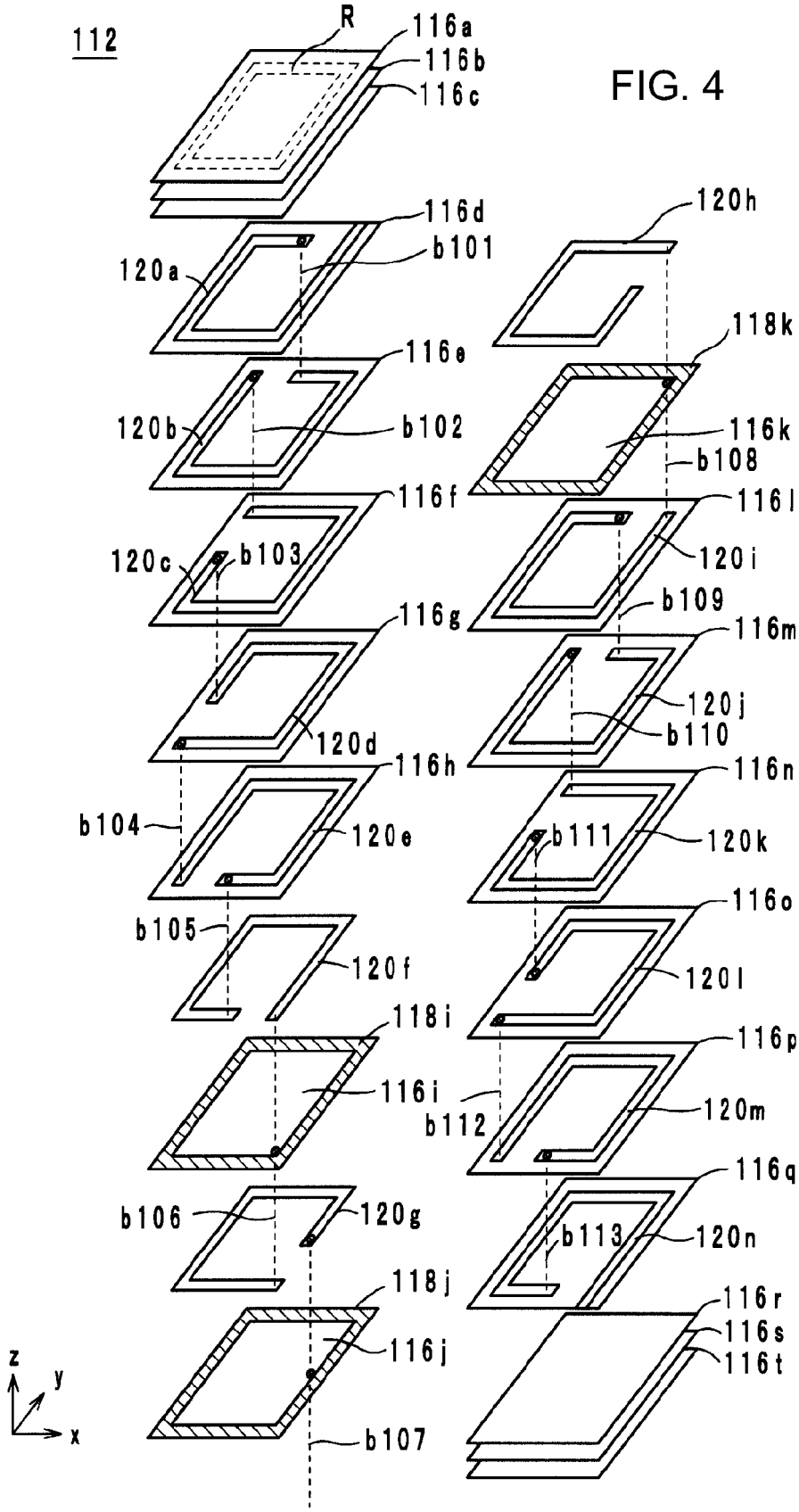
FIG. 4 is an exploded perspective view of a multilayer composite of the electronic component of a comparative example.
Figure 5:
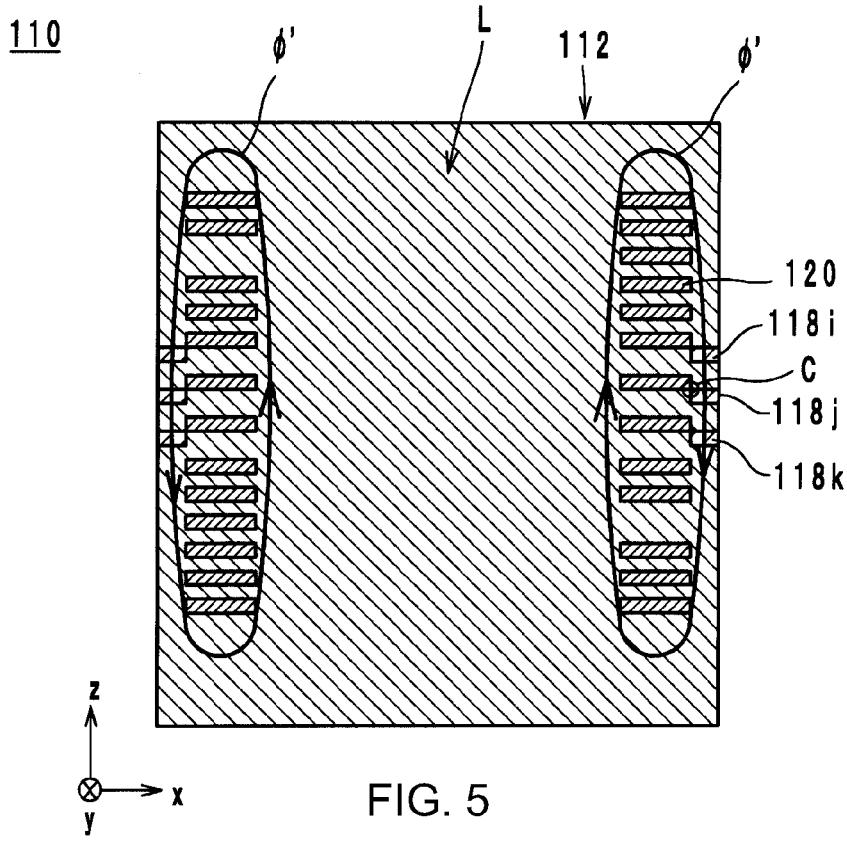
FIG. 5 is a cross-sectional view of the electronic component of the comparative example.

In addition, the electronic component 10 and its manufacturing method provide a superior DC-superimposing characteristic as described below. FIG. 4 is an exploded perspective view of a multilayer composite 112 of an electronic component 110 of a comparative example. FIG. 5 is a schematic sectional view of the electronic component 110 of the comparative example. Parts of the comparative electronic component 110 are designated by reference numerals made by adding 100 to the reference numerals of previously described corresponding parts.

The comparative electronic component 110 is different from the electronic component 10 according to the above-described embodiment of the present invention in that the second insulating layers 118*i* to 118*k* are provided, or disposed only outside the locus R of the coil without overlapping with the locus R, as shown in FIGS. 4 and 5. The other parts of the comparative electronic component 110 are the same as those of the electronic component 10 according to the above embodiment of the present invention. In the comparative electronic component 110 as well, the magnetic flux φ' generated in the coil L passes through the second insulating layers 118*i* to 118*k* of a non-magnetic material, as shown in FIG. 5. Consequently, the magnetic saturation in the multilayer composite 112 can be prevented, and the electronic component 110 can exhibit a superior DC-superimposing characteristic.

However, the DC-superimposing characteristic of the comparative electronic component 110 may be degraded due to variation in manufacture. More specifically, the outer ends of the coil conductors 120 and the inner ends of the second insulating layers 118 are in line with each other as indicated by C in FIG. 5 when the electronic component 110 is viewed in the z-axis direction. If some layers of the stack of the first insulating layers 116 and the second insulating layers 118 are misaligned, a gap may be formed between the end of the coil conductor 120 and the second insulating layer 118. If a gap is formed between any ends of the coil conductors 120 and the second insulating layers 118, the magnetic flux φ' is concentrated on the gap. Thus, a magnetic saturation occurs in the multilayer composite 112 to degrade the DC-superimposing characteristic of the comparative electronic component 110.

On the other hand, in the electronic component 10 according to the above-described exemplary embodiment, the second insulating layers 18 are provided, or disposed in the region coinciding with the locus R of the coil L, as shown in FIGS. 2 and 3. Accordingly, even if misalignment of layers of the stack of the first insulating layers 16 and the second insulating layers 18 occurs in the electronic component 10, a gap between the end of the second insulating layer 18 and the coil conductor 20 is less easily formed than in the comparative electronic component 110. Consequently, the magnetic flux φ passes through the second insulating layers 18 of a non-magnetic material more reliably than the magnetic flux φ' in the comparative example. Consequently, the magnetic saturation is prevented in the multilayer composite 12 of the electronic component 10 according to the above embodiment, and a superior DC-superimposing characteristic can be achieved.

The present inventors made the following experiment to show the effects of the electronic component 10 and its manufacturing method. For the experiment, a first sample of the electronic component 10 according to the above embodiment and a second sample of the comparative example (electronic component 110) were prepared, and their DC-superimposing characteristics were measured under the following conditions: chip size: 2.5 mm by 2.0 mm by 1.2 mm; coil conductor size: 1.9 mm by 1.5 mm; line width of coil conductor: 0.3 mm; diameter of via hole conductor: 0.15 mm; and width of vacancies B1 to B8: 0.2 mm.

Figure 6:
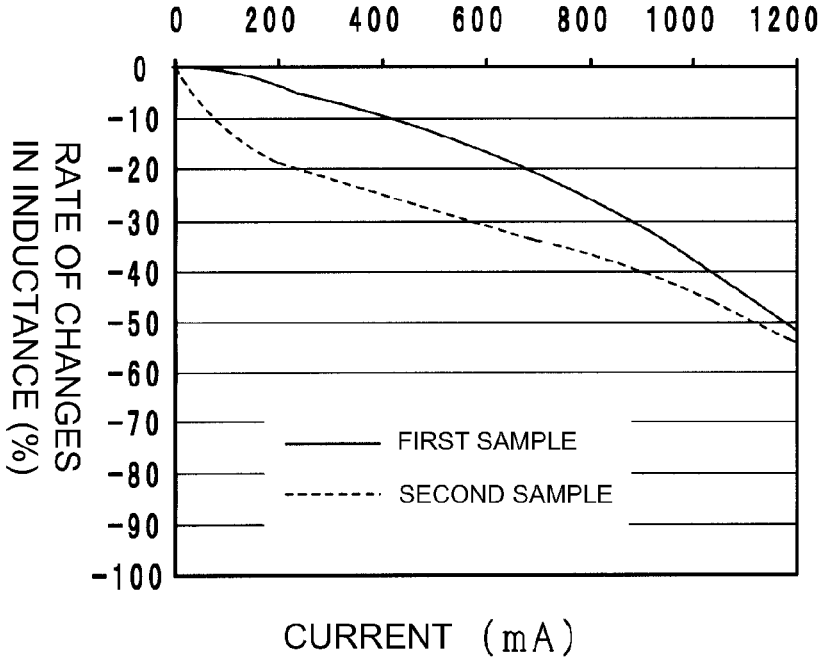
FIG. 6 is a plot of experimental results.

The rate of changes in inductance was measured by applying a current to the coil L. The rate of changes in inductance is obtained from the equation: (inductance at 0 mA−inductance when a current applied)/inductance at 0 mA×100. FIG. 6 is a plot of the results of the experiment. The vertical axis represents the rate of changes in inductance and the lateral axis represents the current.

FIG. 6 shows that when the current is increased, the inductance of the second sample is rapidly reduced. On the other hand, the inductance of the first sample is reduced less rapidly than that of the second sample. The results of the experiment show that the electronic component 10 has a superior DC-superimposing characteristic to the comparative electronic component 110.

Examples of Modifications

Figure 7:
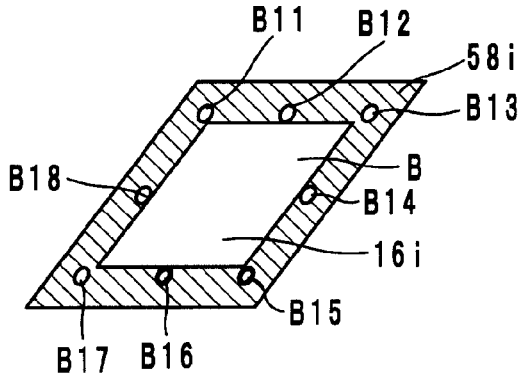
FIG. 7 is a perspective view of a second insulating layer according to a first exemplary modification of the embodiment.

In some embodiments, the insulating layers 18 can be modified as below. FIG. 7 is a perspective view of a second insulating layer according to a first exemplary modification of the above-described embodiment. The second insulating layer 58*i* shown in FIG. 7 is different from the second insulating layer 18*i* of the above embodiment in the shape of the vacancies B11 to B18. More specifically, in the above-described electronic component 10, the vacancies B1 to B8 of the second insulating layer 18*i* continue to the opening B as shown in FIG. 2. On the other hand, the second insulating layer 58*i* of the first exemplary modification has separate circular vacancies B11 to B18 having substantially the same diameter as the via hole conductors b1 to b13. Accordingly, the area of the second insulating layer 58*i* of the non-magnetic material is increased. Consequently, the magnetic saturation can be suppressed effectively in the multilayer composite 12. In this instance, it is preferable that the vacancies B11 to B18 of the modification have a slightly larger diameter than the via hole conductors b1 to b13. Such a structure can prevent the diameter of the passages of the via hole conductors b1 to b13 from being reduced by misalignment of the layers of the stack. For the description of the first exemplary modification, the second insulating layer 58*i* has been described as a representative, and the other second insulating layers 58*j*, 58*k* (not shown) have the same structure as the second insulating layer 58*i*.

Figure 8:
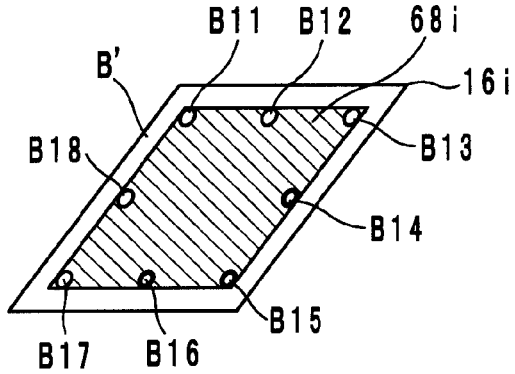
FIG. 8 is a perspective view of a second insulating layer according to a second exemplary modification of the embodiment.

FIG. 8 is a perspective view of a second insulating layer 68*i* according to a second exemplary modification of the above-described embodiment of the electronic component 10. The second insulating layer 68*i* shown in FIG. 8 is provided, or disposed in the region coinciding with the locus R and inside the locus R when viewed in the z-axis direction. The second insulating layer 68*i* has vacancies B11 to B18 therein corresponding to the positions of the via hole conductors b1 to b13 when viewed in the z-axis direction. The electronic component 10 including the second insulating layers 68 (represented by the second insulating layer 68*i*) having such a structure can be manufactured in a simplified manufacturing process and exhibit a superior DC-superimposing characteristic, as with the electronic component 10 including the second insulating layers 18 of the above-described embodiment. For the description of the second exemplary modification, the insulating layer 68*i* has been described as a representative, and the other second insulating layers 68 have the same structure as the second insulating layer 68*i*.

In the insulating layer 68*i* shown in FIG. 8, the vacancies B11 to B18 may continue to the vacant region B' around the second insulating layer 68*i*.

Figure 9:
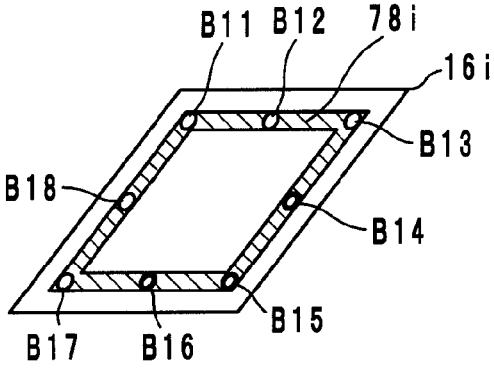
FIG. 9 is a perspective view of a second insulating layer according to a third exemplary modification of the embodiment.

FIG. 9 is a perspective view of a second insulating layer 78*i* according to a third exemplary modification of the above-described embodiment of the electronic component 10. The second insulating layer 78*i* shown in FIG. 9 is provided, or disposed in only the region coinciding, or overlapping with the locus R when viewed in the z-axis direction. The second insulating layer 78*i* has vacancies B11 to B18 therein corresponding to the positions of the via hole conductors b1 to b13 when viewed in the z-axis direction. In the electronic component 10 including the second insulating layers 78 (represented by the second insulating layer 78*i*), the magnetic flux φ shown in FIG. 3 does not pass through the second insulating layers 78. However, the magnetic flux around the coil conductors 20*f* to 20*h* having a shorter magnetic path passes through the insulating layers 78. Accordingly, the electronic component 10 including the insulating layers 78 (represented by the second insulating layers shown in FIG. 9) can exhibit a superior DC-superimposing characteristic. For the description of the third exemplary modification, the insulating layer 78*i* has been described as a representative, and the other second insulating layers 78 have the same structure as the second insulating layer 78*i*.

The second insulating layers 18, 58, 68 and 78 do not cover the via hole conductors b1 to b13. Accordingly, the insulating layers 18, 58, 68 and 78 each have 8 vacancies B1 to B8 or B11 to B18. However, the number of the vacancies provided in the second insulating layers is not always necessarily eight. For example, three via hole conductors b6 to b8 may pass through corresponding insulating layers 18, as shown in FIG. 2. The vacancies are formed at least at positions coinciding with the via hole conductors passing through the first insulating layers 16 on which the respective second insulating layers 18, 58, 68 and 78 are provided.

The electronic component according to embodiments of the claimed invention and its manufacturing method simplify the manufacturing process of electronic components.

While exemplary embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. An electronic component comprising:

a multilayer composite formed by stacking in a stacking direction a plurality of first insulating layers each having a first magnetic permeability and a plurality of second insulating layers, each said second insulating layer having a same shape when viewed in the stacking direction and each having a second magnetic permeability lower than the first magnetic permeability; and a helical coil disposed within the multilayer composite in a region overlapping with the second insulating layers when viewed in the stacking direction, the helical coil including a plurality of coil conductors connected to each other with a plurality of via hole conductors, at least two of which are spaced laterally from each other when viewed in the stacking direction, wherein each of the second insulating layers are provided without overlapping any of the via hole conductors, in the region where the helical coil is disposed when viewed in the stacking direction.

2. The electronic component according to claim 1, wherein the second insulating layers are provided in part of a region defined by the multilayer composite when viewed in the stacking direction.

3. The electronic component according to claim 1, wherein the coil has a closed locus when viewed in the stacking direction, and the second insulating layers are provided in the region coinciding with the locus and outside the locus when viewed in the stacking direction.

4. The electronic component according to claim 2, wherein the coil has a closed locus when viewed in the stacking direction, and the second insulating layers are provided in a region coinciding with the locus and outside the locus when viewed in the stacking direction.

5. The electronic component according to claim 1, wherein the coil has a closed locus when viewed in the stacking direction, and the second insulating layers are provided in a region coinciding with the locus and inside the locus when viewed in the stacking direction.

6. The electronic component according to claim 2, wherein the coil has a closed locus when viewed in the stacking direction, and the second insulating layers are provided in the region coinciding with the locus and inside the locus when viewed in the stacking direction.

7. An electronic component comprising:

a multilayer composite formed by stacking in a stacking direction a plurality of first insulating layers each having a first magnetic permeability and a plurality of second insulating layers, each said second insulating layer having a same shape when viewed in the stacking direction and each having a second magnetic permeability lower than the first magnetic permeability; and a helical coil disposed within the multilayer composite in a region overlapping with the second insulating layers when viewed in the stacking direction, the helical coil including a plurality of coil conductors connected to each other with a plurality of via hole conductors, wherein the second insulating layers are provided without covering the via hole conductors, in the region where the helical coil is disposed when viewed in the stacking direction, wherein the coil has a closed locus when viewed in the stacking direction, and the second insulating layers are provided only in the region coinciding with the locus when viewed in the stacking direction.

8. The electronic component according to claim 2, wherein the coil has a closed locus when viewed in the stacking direction, and the second insulating layers are provided only in the region coinciding with the locus when viewed in the stacking direction.

9. A method for manufacturing an electronic component, comprising the steps of:

forming a plurality of first insulating layers each having a first magnetic permeability and each having a via hole therein;

forming a plurality of second insulating layers having a second magnetic permeability lower than the first magnetic permeability, each said second insulating layer having a same shape as each other, on some of the first insulating layers;

filling the via holes with an electroconductive material to form via hole conductors;

forming coil conductors on the first insulating layers and the second insulating layers; and stacking the first insulating layers and the second insulating layers to form a multilayer composite containing a helical coil including the coil conductors and the via hole conductors, wherein the first insulating layers and the second insulating layers are stacked such that the second insulating layers are located in the region defined by the coil when viewed in the direction in which the first insulating layers and the second insulating layers are stacked, at least two of the via hole conductors are spaced laterally from each other when viewed in the stacking direction, and each of the second insulating layers formed on a first insulating layers does not overlap any of the via holes in the stacking direction.

10. The method according to claim 9, wherein the second insulating layers are formed by applying a slurry onto the first insulating layers.

* * * * *